US010622767B2

(12) United States Patent
Wu et al.

(10) Patent No.: US 10,622,767 B2
(45) Date of Patent: Apr. 14, 2020

(54) CABLE CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/225,311

(22) Filed: Dec. 19, 2018

(65) Prior Publication Data

US 2019/0190213 A1 Jun. 20, 2019

(30) Foreign Application Priority Data

Dec. 19, 2017 (CN) ..... 2017 1 1371478

(51) Int. Cl.

| | |
|---|---|
| ***H01R 13/66*** | (2006.01) |
| ***H01R 24/64*** | (2011.01) |
| ***H01R 13/6593*** | (2011.01) |
| ***H01R 13/719*** | (2011.01) |
| ***H01R 13/502*** | (2006.01) |

(52) U.S. Cl.

CPC ..... *H01R 13/6658* (2013.01); *H01R 13/502* (2013.01); *H01R 13/6593* (2013.01); *H01R 13/719* (2013.01); *H01R 24/64* (2013.01)

(58) Field of Classification Search

CPC ..... H01R 13/6658; H01R 13/6592; H01R 13/6593; H01R 13/658; H01R 13/719; H01R 13/502; H01R 9/032; H01R 24/64

USPC ..... 439/76.1, 607.46–607.49

See application file for complete search history.

(56) References Cited

U.S. PATENT DOCUMENTS

| | | | | |
|---|---|---|---|---|
| 6,132,260 | A | 10/2000 | Wu | |
| 7,163,408 | B1 | 1/2007 | Chen et al. | |
| 7,625,236 | B1 | 12/2009 | Wu | |
| 7,651,379 | B1 | 1/2010 | Wu | |
| 7,758,374 | B2 | 7/2010 | Yu et al. | |
| 2008/0050951 | A1* | 2/2008 | Wu | H01R 13/2442 439/108 |
| 2009/0117785 | A1* | 5/2009 | Wu | H01R 24/62 439/668 |

(Continued)

FOREIGN PATENT DOCUMENTS

| | | |
|---|---|---|
| CN | 102480078 | 5/2012 |

*Primary Examiner* — Gary F Paumen

(74) *Attorney, Agent, or Firm* — Wei Te Chung; Ming Chieh Chang

(57) ABSTRACT

A cable connector assembly includes an outer housing, an inner housing received in the outer housing, and a circuit board received in the inner housing. The inner housing includes an insulative member. The circuit board includes a mating portion extending beyond the insulative member that is mated with a mating connector, and a body portion connected with the mating portion. The insulative member holds and supports the circuit board and is mated with the inner housing.

18 Claims, 11 Drawing Sheets

(56) References Cited

U.S. PATENT DOCUMENTS

| | | | | |
|---|---|---|---|---|
| 2010/0093218 | A1* | 4/2010 | Zhang | H01R 13/6658 439/607.45 |
| 2010/0151731 | A1* | 6/2010 | Su | H01R 13/502 439/607.35 |
| 2010/0151732 | A1* | 6/2010 | Xu | H01R 13/506 439/607.45 |
| 2010/0267281 | A1* | 10/2010 | Li | H01R 13/6582 439/607.01 |
| 2011/0059646 | A1* | 3/2011 | Su | H01R 13/5845 439/460 |
| 2013/0210273 | A1* | 8/2013 | Wu | H01R 13/652 439/607.34 |
| 2014/0154921 | A1* | 6/2014 | Qi | H01R 13/6581 439/620.03 |
| 2014/0206207 | A1* | 7/2014 | Ming | H05K 1/0213 439/78 |
| 2015/0171561 | A1* | 6/2015 | Little | H01R 24/60 439/607.34 |
| 2016/0172791 | A1* | 6/2016 | Fan | H01R 13/6585 439/607.05 |
| 2016/0226199 | A1* | 8/2016 | Zhou | H01R 13/7172 |
| 2016/0226200 | A1* | 8/2016 | Xing | H01R 13/7172 |

* cited by examiner

CABLE CONNECTOR ASSEMBLY

BACKGROUND OF THE INVENTION

1. Field of the Invention

The present invention relates, generally, to a cable connector assembly, and more particularly, to a low cost cable connector assembly.

2. Description of Related Arts

With wide application of the USB C interface, it has provided ultra-thin design of notebook computers around the world. Ultra-thinness has become a big selling point for notebooks. Many notebooks nowadays has one USB C connector only.

While simplifying the notebook interface, a single interface may meet the needs of a variety of interfaces.

U.S. Pat. No. 7,163,408 discloses a cable connector assembly including a first outer casing, a second outer casing, and a cable module. The first outer casing has a first front sectional portion. The second outer casing has a second front sectional portion. The cable module includes a printed circuit board, a cable, and an insulating member. The printed circuit board has a plurality of electric pads disposed at a front thereof. The cable has a front electrically connected to a rear of the printed circuit board. The insulating member retains the front of the cable and the rear of the printed circuit board. The printed circuit board is received between the first front sectional portion and the second front sectional portion.

SUMMARY OF THE INVENTION

An object of the present invention is to provide a cable connector assembly which has a simple structure.

To achieve the above-mentioned object, a cable connector assembly includes an outer housing, an inner housing received in the outer housing, and a circuit board received in the inner housing. The inner housing includes an insulative member. The circuit board includes a mating portion extending beyond the insulative member, and a body portion connected with the mating portion. The insulative member holds and supports the circuit board and is mated with the inner housing.

According to the present invention, the cable connector assembly uses the circuit board design, which can meet the requirements of various interfaces, and has a simple structure and a relatively low production cost through the cooperation of the insulative member mounted on the circuit board and the inner housing.

DETAILED DESCRIPTION OF THE PREFERRED EMBODIMENT

Figure 1:
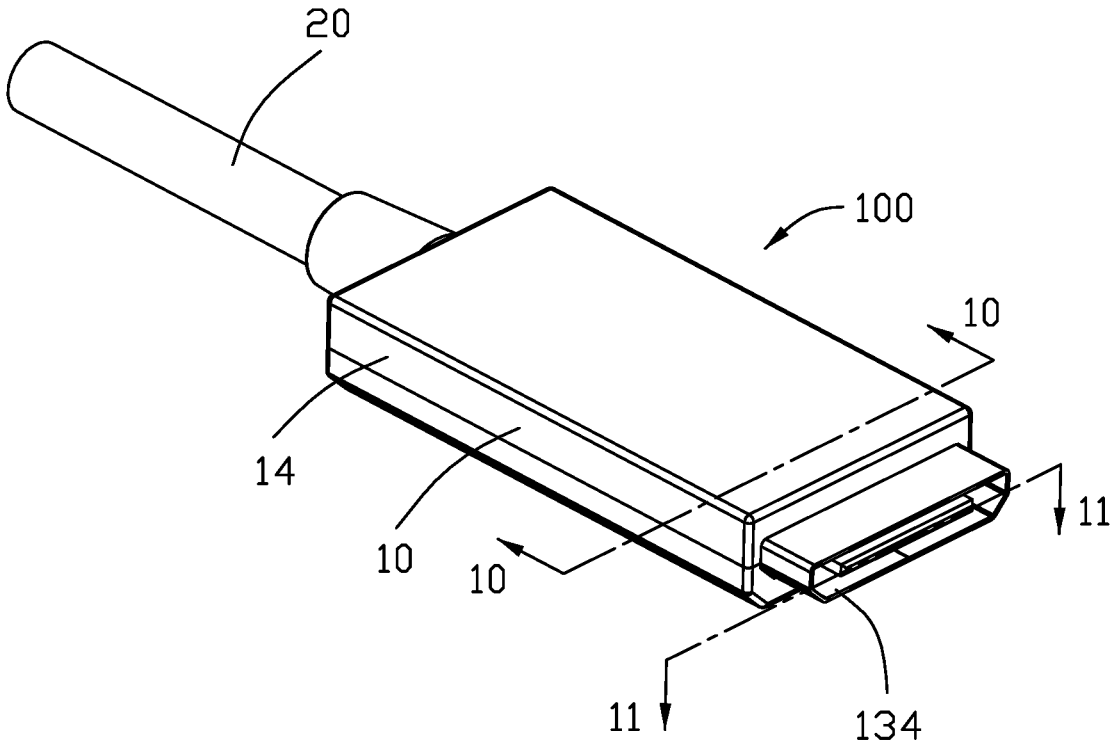
FIG. 1 is a perspective view of an embodiment of a cable connector assembly in accordance with present invention.
Figure 2:
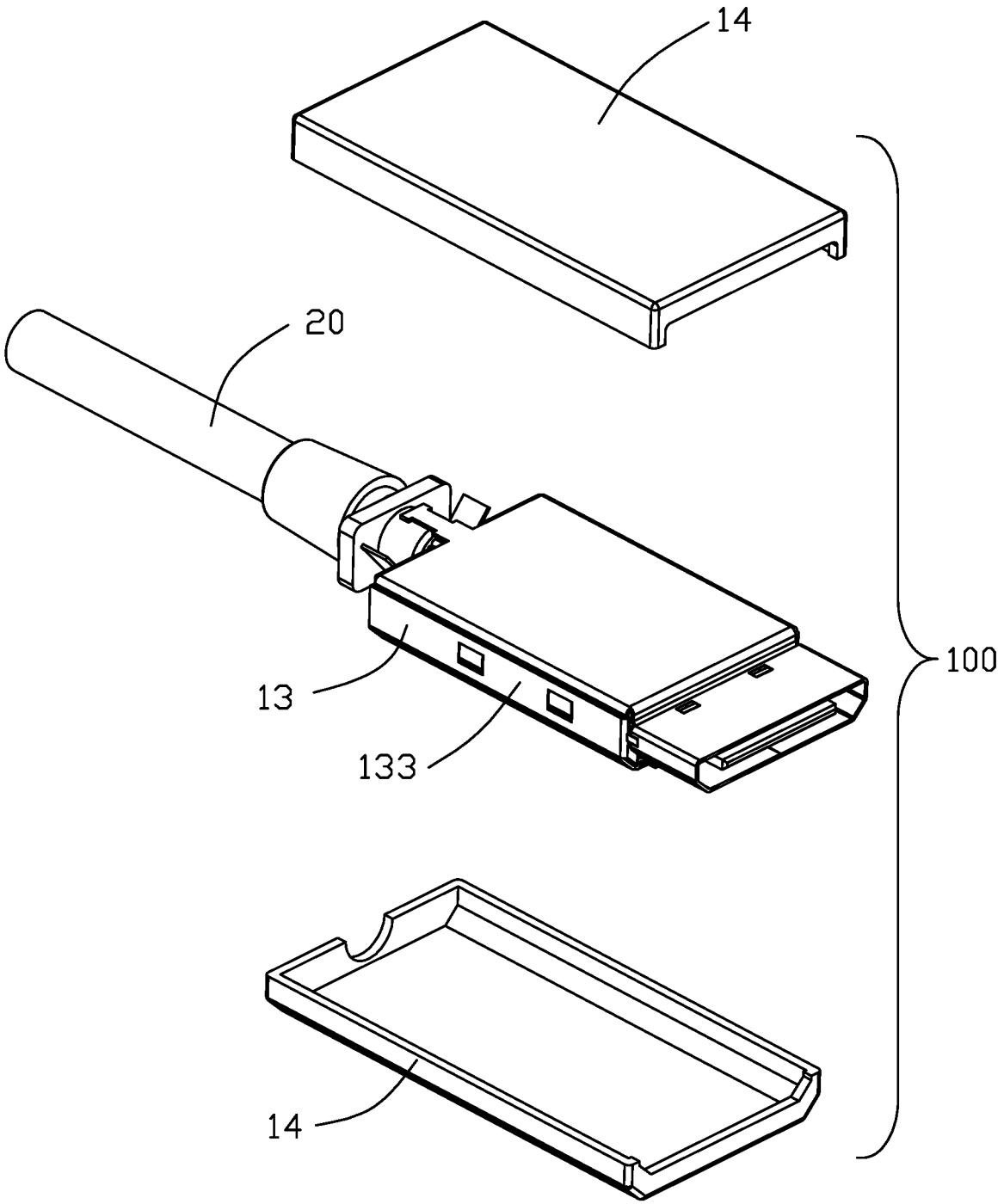
FIG. 2 is a partly exploded view of the cable connector assembly as shown in FIG. 1.
Figure 3:
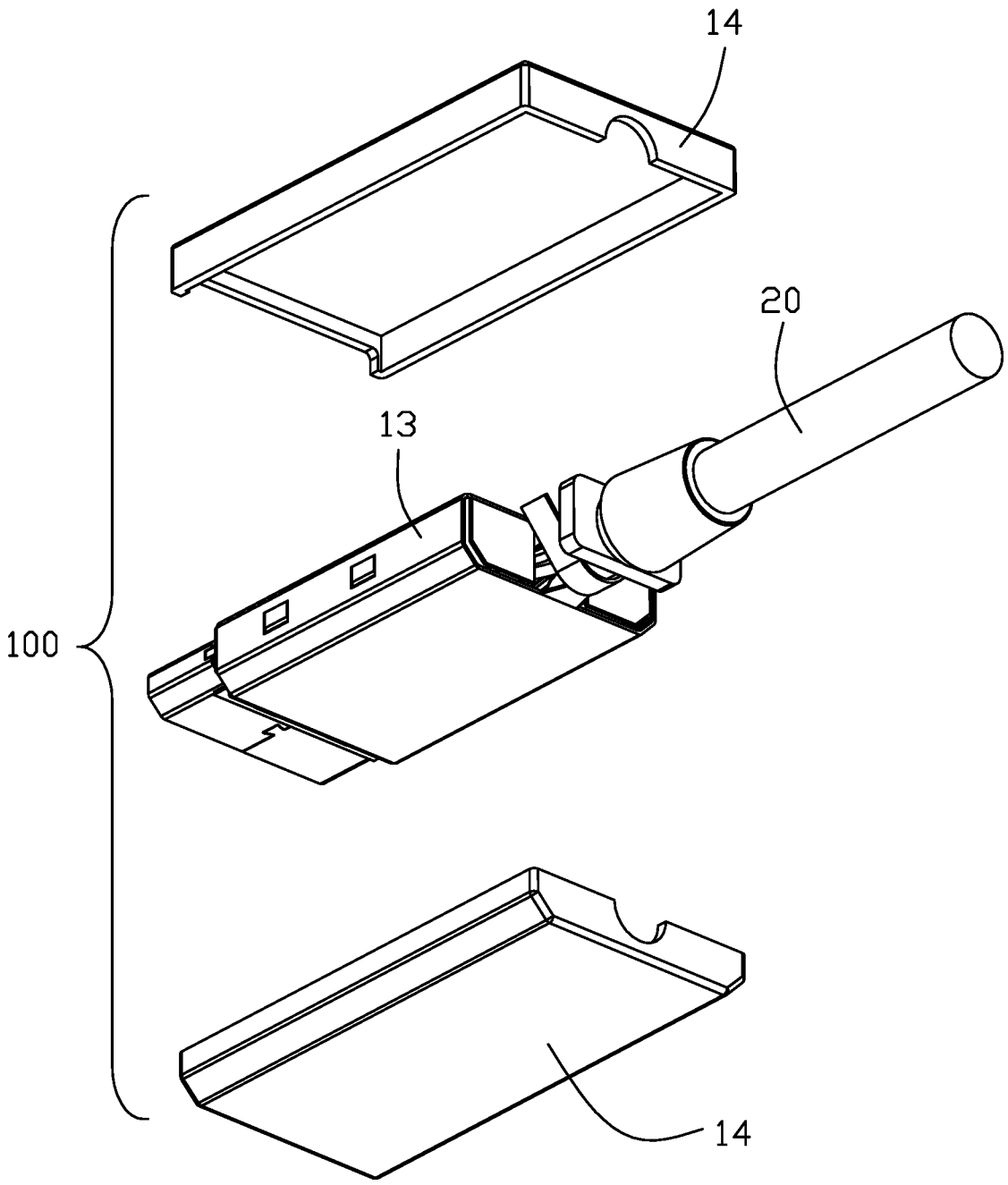
FIG. 3 is a partly exploded view of the cable connector assembly as shown in FIG. 2, but from a different perspective.
Figure 4:
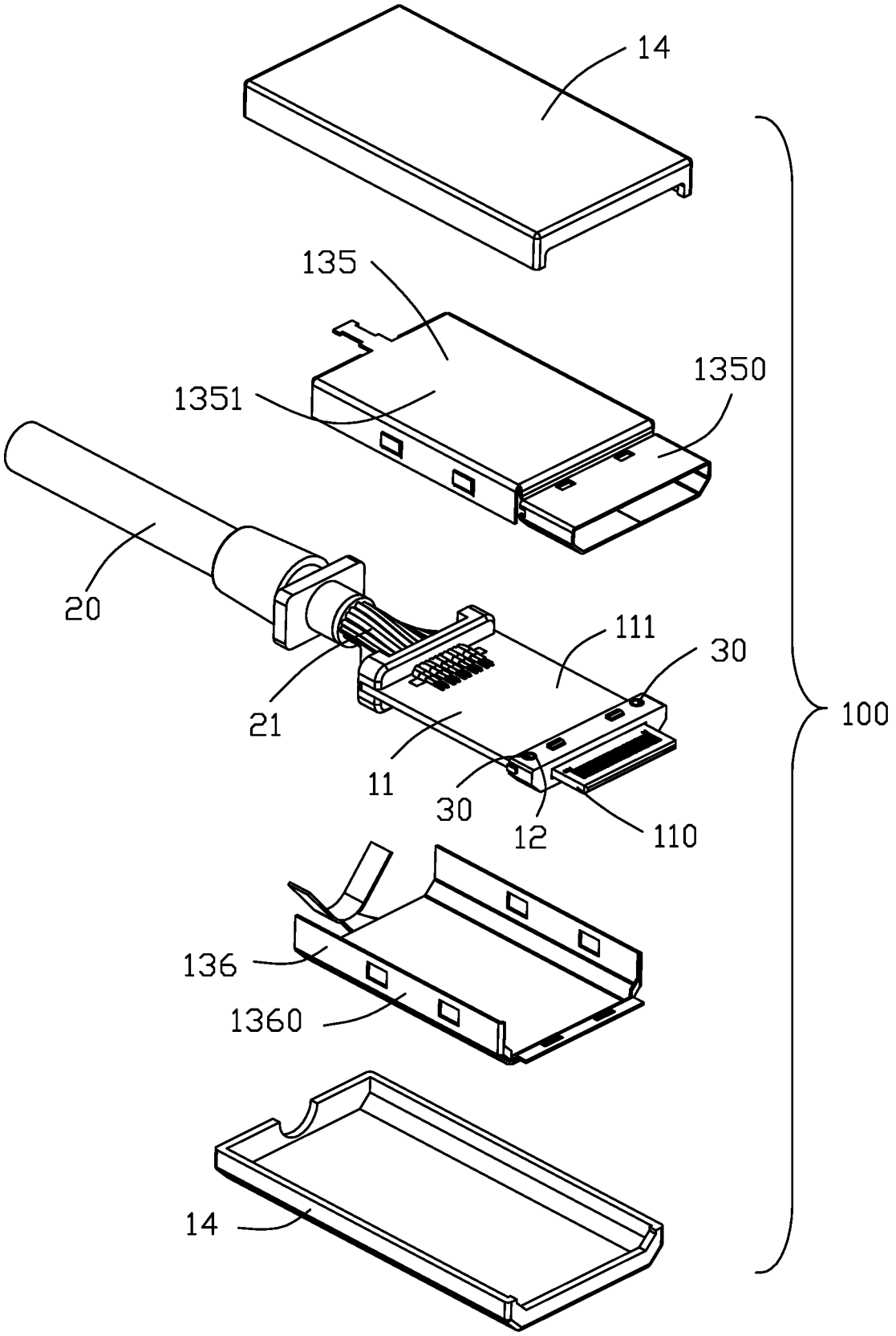
FIG. 4 is a further exploded view of the cable connector assembly as shown in FIG. 2.
Figure 5:
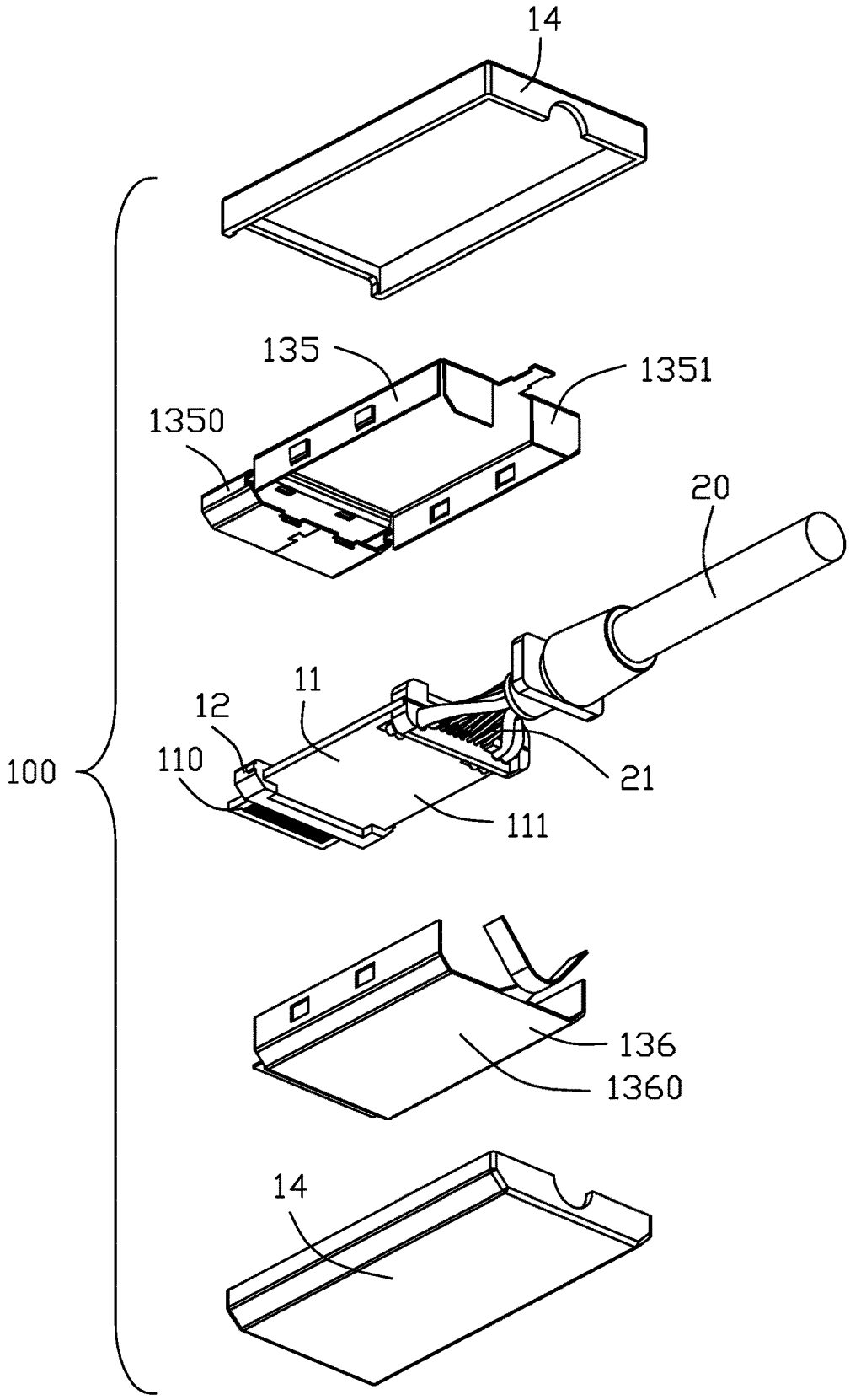
FIG. 5 is a further exploded view of the cable connector assembly as shown in FIG. 4, but from a different perspective.
Figure 6:
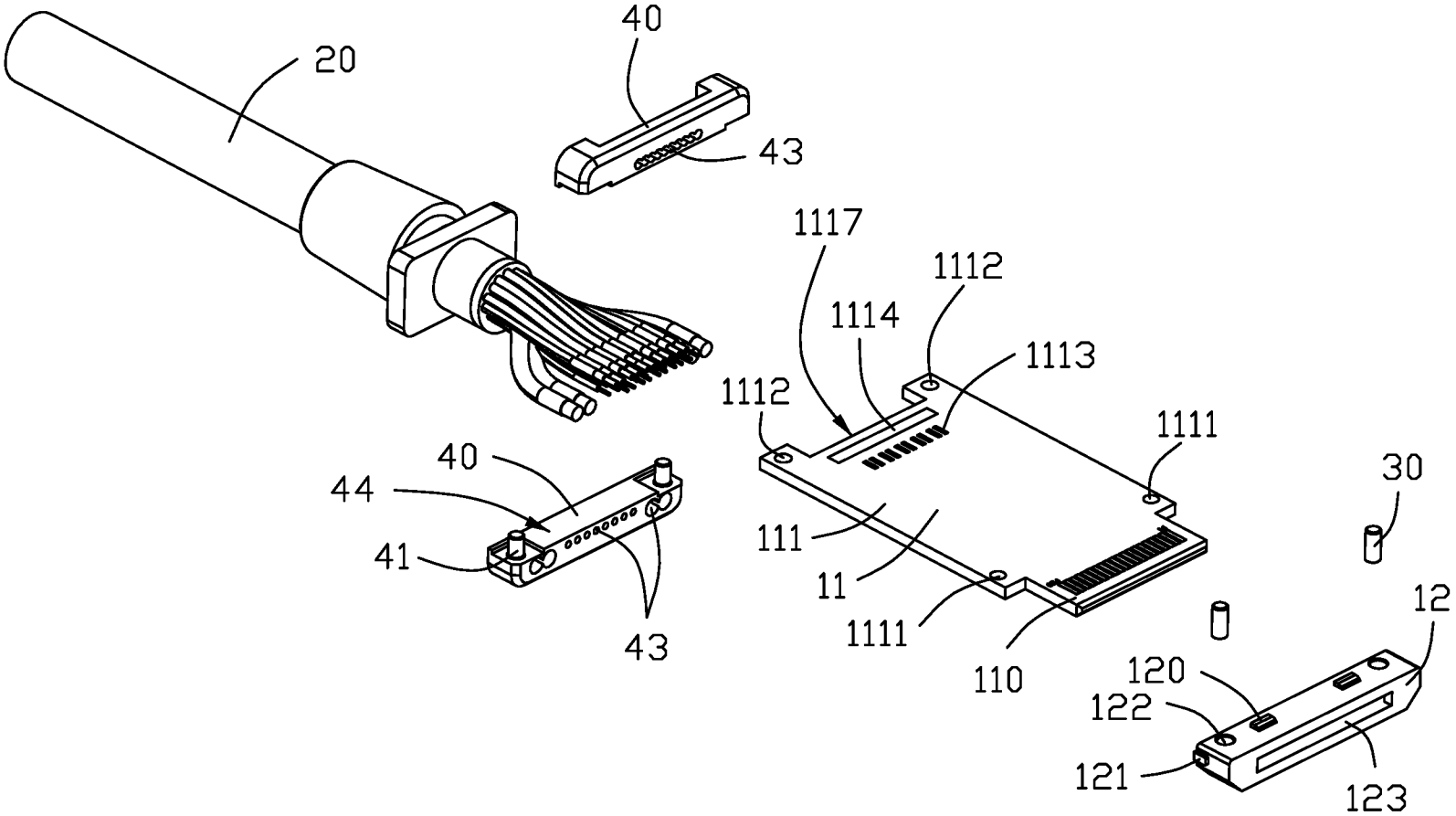
FIG. 6 is a further exploded view of the cable connector assembly after removing the inner housing and the outer housing as shown in FIG. 4.
Figure 7:
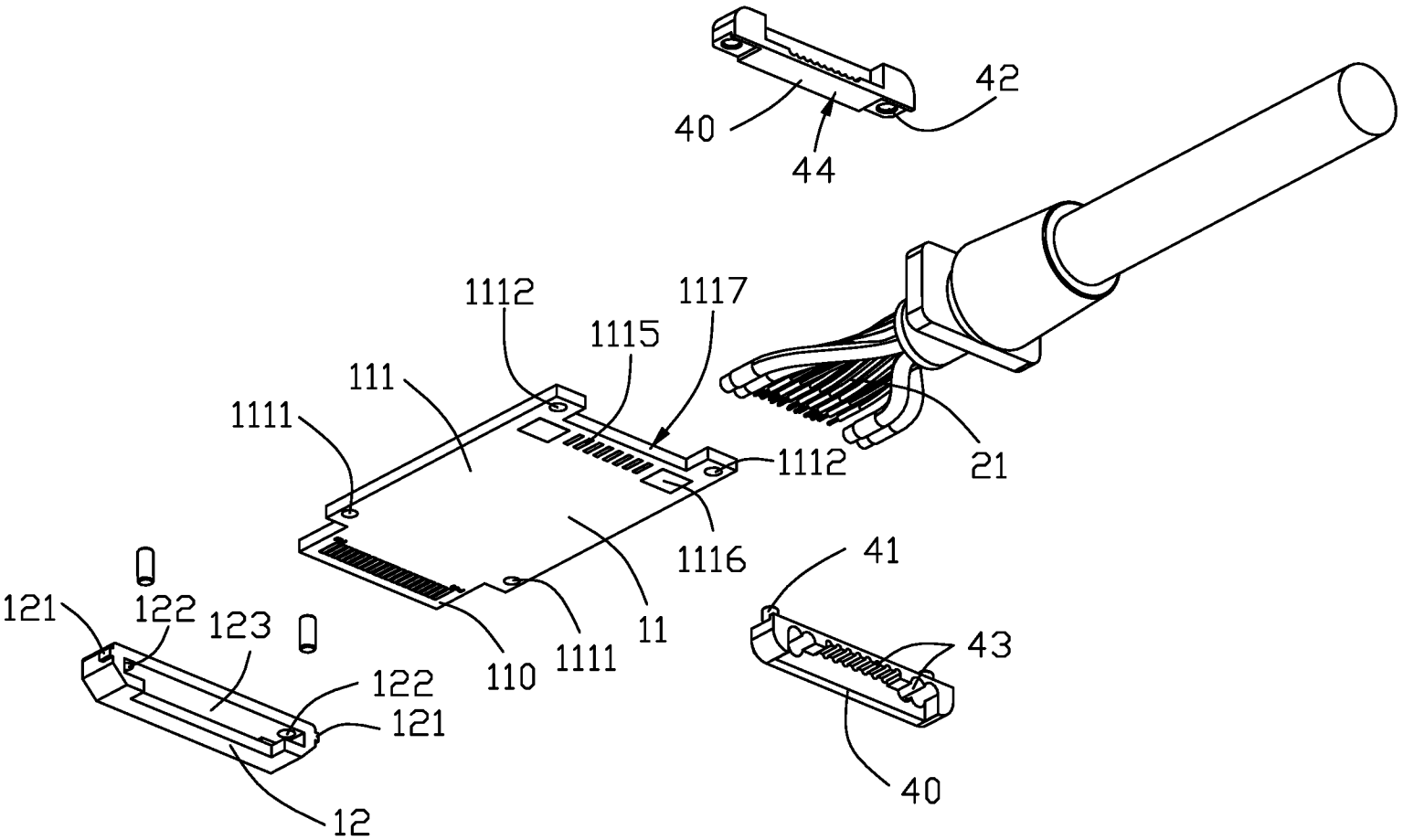
FIG. 7 is a further exploded view of the cable connector assembly after removing the inner housing and the outer housing as shown in FIG. 6, but from a different perspective.
Figure 8:
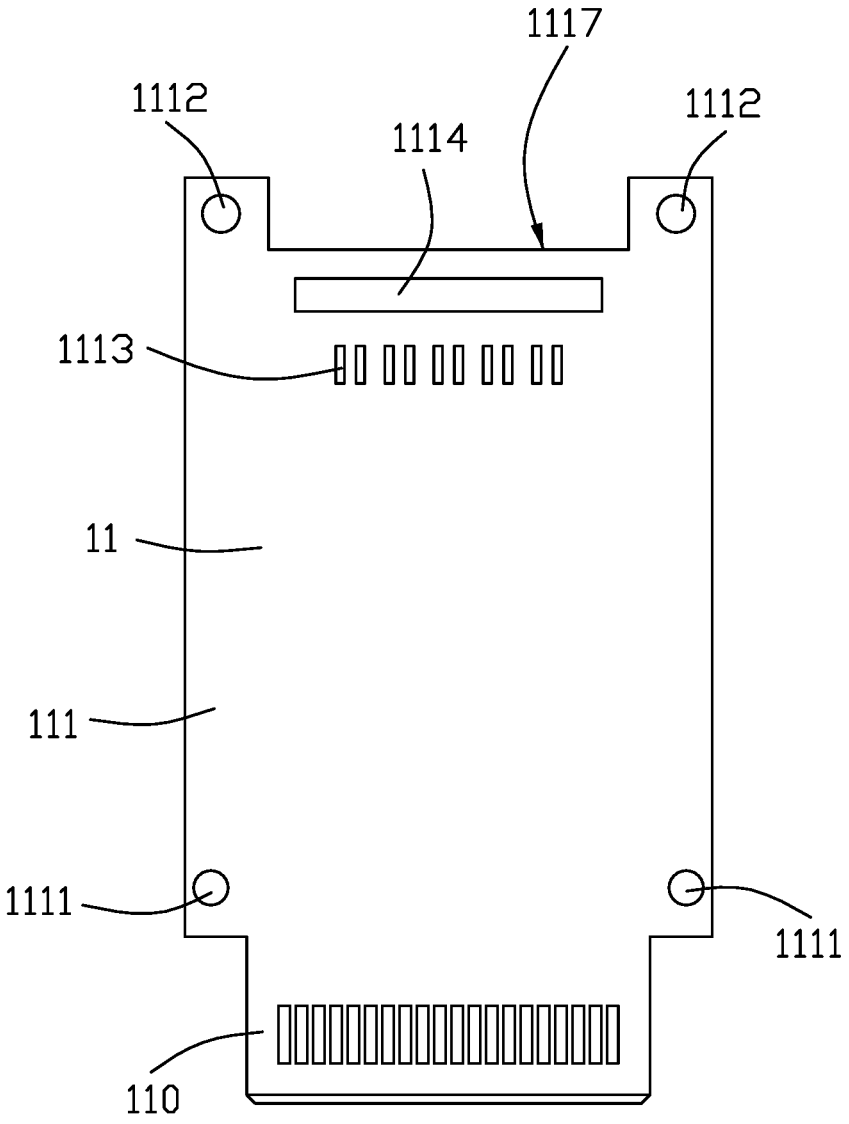
FIG. 8 is a top view of the circuit board of the cable connector assembly as shown in FIG. 6.
Figure 9:
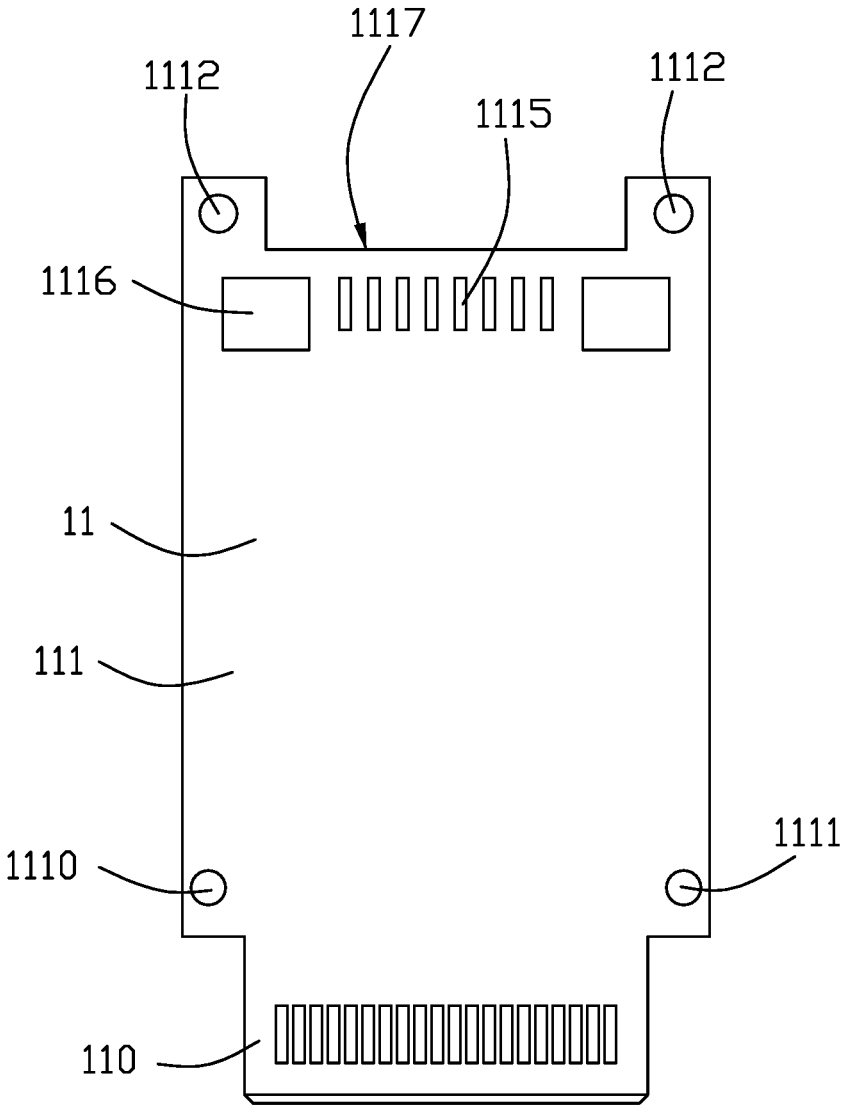
FIG. 9 is a bottom view of the circuit board of the cable connector as shown in FIG. 6.
Figure 10:
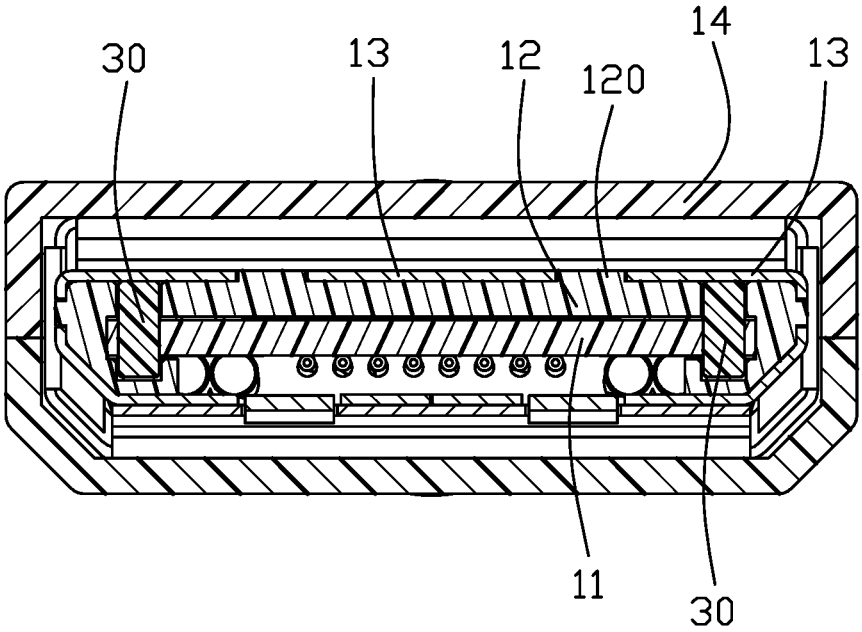
FIG. 10 is a cross-sectional view follow the 10-10 direction as shown in FIG. 1.
Figure 11:
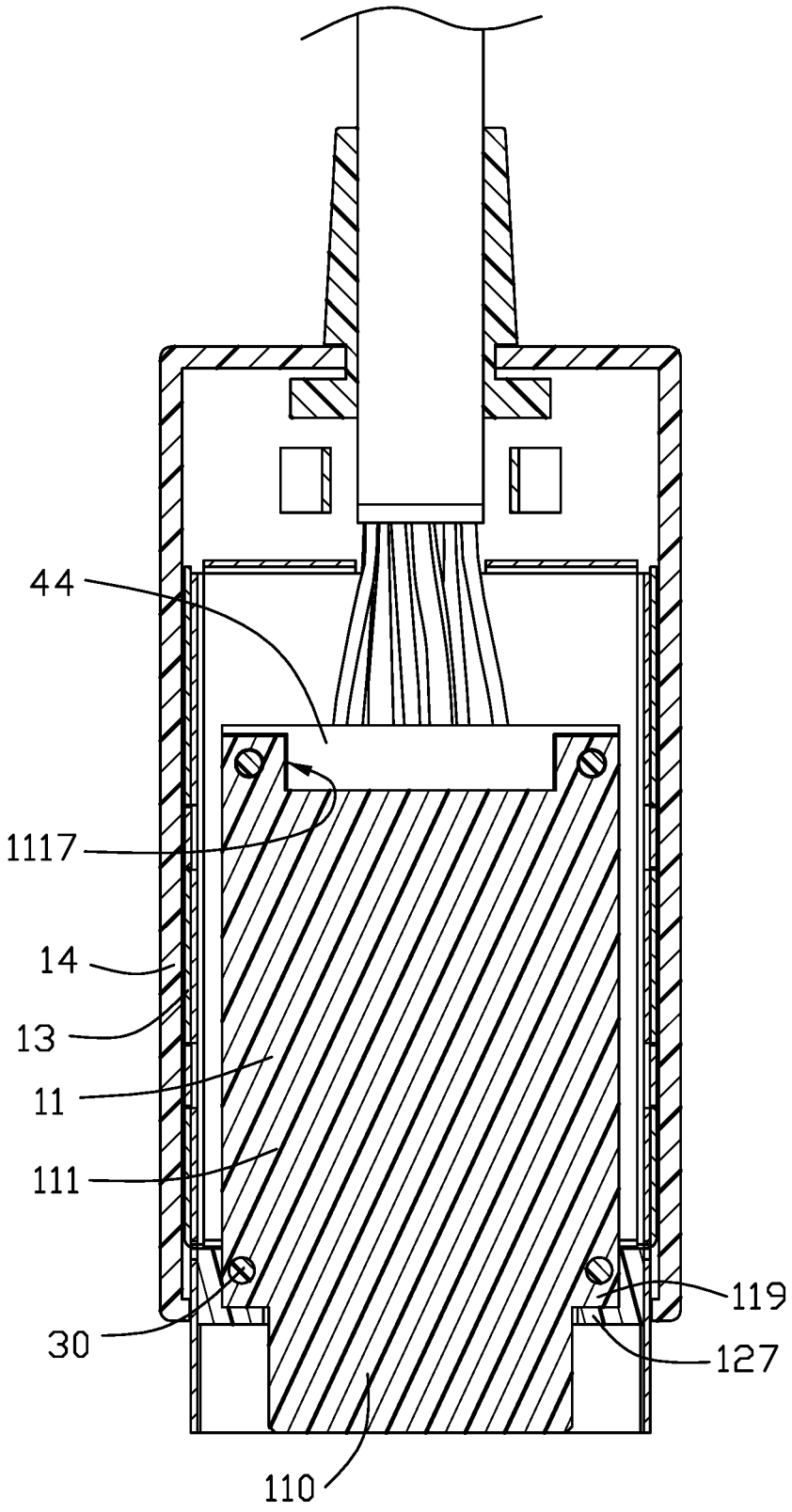
FIG. 11 is a cross-sectional view follow the 11-11 direction as shown in FIG. 1.

Reference will now be made in detail to a preferred embodiment of the present invention. Referring to FIGS. 1 to 11, one end of the cable connector assembly 100 is connected with a USB Type-C connector or other suitable connector for plugging into a notebook computer or other electrical device, other end of the cable connector assembly 100 is connected with a cable connector 10 for connecting with a switch device which has a connector with various interfaces to enable connections of plug connectors of different interfaces to the notebook or other electronic device. The cable connector assembly 100 includes the cable connector 10 and a cable 20 that is mechanically and electrically with the cable connector 10 at one end. The cable connector 10 includes a printed circuit board 11, an insulative member 12 mounted on the circuit board 11 for fixing and supporting the circuit board 11, an inner housing or shell 13 disposed outside the circuit board 11 for receiving the circuit board 11, and an insulative outer housing 14 mounted outside the inner housing 13. The insulative member 12 is fixed with the inner housing 13. The cable connector 10 of the present invention is mostly locked in the switch device, and does not require of plug-in durability of 10000 times, so that the circuit board 11 can be mated with a mating connector, to provide a better high-frequency transmission ability, a smooth impedance control, and a little transmission loss. Compared with the structures of terminals it can save a large amount of mold cost, so that the cost is low and the economic benefit is considerable.

The circuit board 11 includes a mating portion 110 extending beyond the insulative member 12 and having mating pads (not labeled) thereon for being mated with a mating connector, and a body portion 111 connected with the mating portion. The width of the body portion 111 of the circuit board 11 is greater than the width of the mating portion. The body portion 111 has a mounting through hole 1111 crossing through the circuit board 11 at both sides of the end adjacent the mating portion 110, and a through hole 1112 crossing through the circuit board 11 at both sides of the end adjacent the cable 20. The mounting through hole 1111 and the through hole 1112 are disposed at the position where the width of the body portion 111 is greater than the width of the mating portion 110. The body portion 111 of the circuit board has a plurality of pairs of high-speed signal pads 1113 arranged in a row that transmits a high speed signal and a row of strip-shaped ground pads 1114 disposed behind the high-speed signal pads 1113 at the end adjacent the cable 20. The other end of the body portion 111 has a row of low-speed signal pads 1115 that transmits low-speed signal and a plurality of power signal pads 1116 disposed at both sides of the low-speed signal pads 1115. The width of the power signal pads 1116 is greater than the width of the low-speed signal pads 1115 for supporting the transmission of the high voltage and high current. The cable 20 includes a plurality of core wires 21 that are soldered with the corresponding high-speed signal pads 1113, grounding pads 1114, low-speed signal pads 1115 and power signal pads 1116. In this embodiment, each pair of high-speed signal pads 1113 can support signal speed of 10 Gbp/s, and the power signal pads 1116 can support voltage of 20V, current of 10 A, so that the cable connector assembly 100 of the present invention can support the power transmission of 200 Watt. The circuit board 11 adopts the four-layer or six-layer design, which combines high frequency, high speed signal transmission and high current transmission.

One of an upper surface and a lower surface has a protrusion 120 disposed thereof. The insulative member 12 has a card block 121 disposed at the side thereof. The insulative member 12 includes a mounting slot 123 crossing through the insulative member 12 in the front-rear direction, the insulative member 12 sleeved on the circuit board 11, the mating portion 110 of the circuit board 11 extending beyond the insulative member 12. The insulative member 12 has a pin hole 122 corresponding to the mounting through hole 1111, and the circuit board 11 is fixed with the insulative member 12 through the pin hole 122 and a fixing pin 30 in the mounting through hole 1111.

The inner housing 13 is stamped from a metal strip. The inner housing 13 has a through hole 130 mated with the protrusion 120 of the insulative member 12 and a card slot 131 mated with the card block 121 of the insulative member 12. The inner housing 13 includes a body 133 received in the outer housing 14 and a mating portion 134 disposed in front of the body 133, the mating portion 110 of the circuit board 11 overhung in the mating portion 134. The inner housing 13 includes a first housing 135 and a second housing 136 mated with the first housing 135. The first housing 135 includes a first/front portion 1350 that is closed at the periphery and a second portion 1351 that is not closed at the periphery, the mating portion 110 of the circuit board 11 received in the first portion 1350 that is closed at the periphery, the second housing 136 including a third portion 1360 that is not closed at the periphery, the third portion 1360 cooperated with the second portion 1351 to receive the body portion 111 of the circuit board 11. The first portion 1350 can protect the mating portion 110 of the circuit board 11 from being touched or damaged, and can provide the overall strength.

The cable connector assembly 100 further includes a spacer composed of a pair of limiting blocks 40 mounted on the circuit board 11 that receives and limits the core wires 21. One of the limiting blocks 40 has, at two opposite end regions, a pair of mounting columns 41 disposed respectively thereon, and the other limiting block 40 has, at two opposite end regions, a pair of mounting holes 42 disposed respectively thereon, and each mounting column 41 goes through the corresponding though hole 1112 and the corresponding mounting hole 42 to achieve the mating of the pair of limiting blocks. Each limiting block 40 forms a vertical protrusion 44 between either the pair of mounting columns 41 or the pair of mounting holes. A notch 1117 is formed in a rear edge of the printed circuit board 11, and the vertical protrusion 44 of each limiting blocks 40 is received within the notch 1117 for stabilization consideration. Each limiting block 40 further forms a plurality of through holes 43 to receive the corresponding core wires 21, respectively.

The cable connector assembly 100 of the present invention uses the circuit board 11 design, which can meet the requirements of switch channels of various interfaces, and has a simple structure and a relatively low production cost through the cooperation of the insulative member 12 mounted on the circuit board 11 and the inner housing 13. Notably, in the instant invention, the insulative member 12 and the pair of limiting blocks 40 respectively located at opposite front and rear end regions of the circuit boards 11 so as to support the metallic inner housing 13 and stably retain the circuit board 11 within the metallic inner housing 13. The insulative member 12 includes a front wall 127 which the mating portion of the circuit board 11 extends and the shoulder 119 behind the mating portion of the circuit board 11 forwardly confronts and abuts against. In brief, the insulative member is fixed to a front region of the circuit board and the cable is connected to the rear region of the circuit board and regulated by the pair of limiting blocks wherein the insulative member and the pair of limiting blocks function as the supporters to maintain the spatial relation between the metallic inner housing and the printed circuit board in the vertical direction.

What is claimed is:

1. A cable connector assembly comprising:

an outer housing;

an inner housing received in the outer housing;

an insulative member mated with the inner housing; and a circuit board received in the inner housing, the circuit board comprising a mating portion extending beyond the insulative member and a body portion connected with the mating portion; wherein the insulative member holds and supports the circuit board; and the circuit board comprises a mounting through hole, the insulative member comprises a pin hole corresponding to the mounting through hole, and the circuit board is fixed to the insulative member through a fixing pin mounted in the pin hole and the mounting through hole.

2. The cable connector assembly of claim 1, wherein a protrusion is disposed on at least one of an upper surface and a lower surface of the insulative member, and the inner housing comprises a through hole mated with a corresponding protrusion.

3. The cable connector assembly of claim 2, wherein the inner housing comprises a body received in the outer housing and a mating portion disposed in front of the body, the mating portion of the circuit board overhung in the mating portion.

4. The cable connector assembly of claim 3, wherein the inner housing comprises a first housing and a second housing mated with the first housing.

5. The cable connector assembly of claim 4, wherein the first housing comprises a first portion having a closed periphery and a second portion having an open periphery and connected with the first portion, the mating portion of the circuit board received in the first portion, the second housing comprising a third portion that is closed at the periphery, the third portion mated with the second portion for receiving the body of the circuit board.

6. The cable connector assembly of claim 1, wherein the insulative member comprises a block disposed at a side edge thereof, and the inner housing comprises a slot mated with the block.

7. The cable connector assembly of claim 1, wherein a width of the body of the circuit board is greater than a width of the mating portion, the mounting through hole disposed at the position of the body where it is wider than the mating portion.

8. The cable connector assembly of claim 1, further comprising a cable electrically connected with the circuit board and a pair of limiting blocks, the cable comprising a number of core wires received on corresponding limiting blocks.

9. The cable connector assembly of claim 8, wherein one of the limiting blocks comprises a mounting column and another one of the limiting blocks comprises a mounting hole, the circuit board comprising a corresponding through hole, the mounting column extending through the through hole to mate with the mounting hole.

10. A cable connector assembly comprising:

a printed circuit board defining opposite front and rear regions in a front-to-back direction, a mating portion formed on the front region and having mating pads thereon;

an insulative member secured to the front region, through which the mating portion extends forwardly;

a spacer secured to the rear region and holding therein a plurality of wires which are fixed upon the printed circuit board; and a metallic inner housing intimately enclosing both the insulative member and the spacer in a vertical direction perpendicular to the front-to-back direction while being spaced from the printed circuit board in the vertical direction; wherein the printed circuit board forms a pair of shoulders behind the mating portion, and the insulative member includes a front wall against which the shoulders abut forwardly; wherein the printed circuit board forms a pair of mounting through holes around the pair of shoulders, and a pair of fixing pins extend through the corresponding mounting through holes to secure the insulative member to the front region of the printed circuit board.

11. The cable connector assembly as claimed in claim 10, wherein the insulative member and the inner housing have means for securing together.

12. The cable connector assembly as claimed in claim 10, wherein said wires are enclosed within a cable which extends rearward from the metallic inner housing and is grasped by said metallic inner housing.

13. The cable connector assembly as claimed in claim 10, wherein the metallic inner housing has a front portion in which the mating portion is protectively received.

14. The cable connector assembly as claimed in claim 10, wherein the insulative member is an unitary one piece while the spacer includes a pair of limiting blocks assembled together with the printed circuit board sandwiched between in the vertical direction.

15. The cable connector assembly as claimed in claim 10, further including an insulative outer housing enclosing the metallic inner housing.

16. A cable connector assembly comprising:

a printed circuit board defining opposite front and rear regions in a front-to-back direction, a mating portion formed on the front region and having mating pads thereon, a notch formed in a rear edge of the printed circuit board;

an insulative member secured to the front region, through which the mating portion extends forwardly;

a spacer secured to the rear region and holding therein a plurality of wires which are fixed upon the printed circuit board; and a metallic inner housing intimately enclosing both the insulative member and the spacer in a vertical direction perpendicular to the front-to-back direction while being spaced from the printed circuit board in the vertical direction; wherein the insulative member is an unitary one piece while the spacer includes a pair of limiting blocks secured to each other at two opposite end regions with the printed circuit board sandwiched therebetween in the vertical direction; wherein each of said limiting blocks forms a vertical protrusion located between said two opposite end regions and received within the notch.

17. The cable connector assembly as claimed in claim 16, wherein a plurality of high speed signal pads and at least one ground pad are formed on one surface of the rear region, and a plurality of low speed signal pads and power signal pads are formed on the other surface of the rear region for connection with the corresponding wires, respectively.

18. The cable connector assembly as claimed in claim 16, wherein each of said limiting blocks forms a plurality of through holes along the front-to-back direction to receive the corresponding wires, respectively.

* * * * *